US005411467A

United States Patent [19]

Hortmann et al.

[11] Patent Number: 5,411,467

[45] Date of Patent: May 2, 1995

[54] IMPLANTABLE HEARING AID

[75] Inventors: Gunter Hortmann, Neckartenzlingen; Hans Leysieffer, Taufkirchen, both of Germany

[73] Assignee: Implex GmbH Spezialhorgerate, Germany

[21] Appl. No.: 530,582

[22] Filed: May 30, 1990

[30] Foreign Application Priority Data

Jun. 2, 1989 [DE] Germany ..... 39 18 086.7

[51] Int. Cl.[6] ..... H04R 25/00

[52] U.S. Cl. ..... 600/25; 607/57

[58] Field of Search ..... 600/25; 128/420.5, 420.6; 623/10-11; 381/68-69.2; 181/126, 128, 129, 130, 132, 133, 134, 135; 607/55-57

[56] References Cited

U.S. PATENT DOCUMENTS

| | | | |
|---|---|---|---|
| 3,594,514 | 7/1971 | Wingrove | 600/25 |
| 4,729,366 | 3/1988 | Schaefer | 128/420.6 |
| 4,756,312 | 7/1988 | Epley | 128/420.5 |
| 4,850,962 | 7/1989 | Schaefer | 128/420.6 |
| 4,988,333 | 1/1991 | Engebretson | 128/420.6 |

*Primary Examiner*—Kyle L. Howell
*Assistant Examiner*—John P. Lacyk
*Attorney, Agent, or Firm*—Sixbey, Friedman, Leedom & Ferguson; David S. Safran

[57] ABSTRACT

Implantable hearing aid for stimulation of the inner ear with a hydromechanical coupling element having an input side connected to an electromechanical converter for transmission to the inner ear of the mechanical vibrations generated by the converter.

28 Claims, 2 Drawing Sheets

IMPLANTABLE HEARING AID

BACKGROUND OF THE INVENTION

The invention relates to an implantable hearing aid for stimulation of the inner ear.

In a known hearing aid for stimulation of the inner ear (German Offenlegungsschrift 28 25 233), the subassemblies forming the hearing aid, including a tritium battery, are hermetically encapsulated and are placed in the external auditory canal or are implanted in the mastoid, and the hearing aid is connected by an electric line directly to the auditory nerve on the output side. In a modified embodiment of the known aid, acoustic vibrations generated by the hearing aid implanted in the mastoid are transmitted by the mastoid-bone process into the middle ear by exploiting the fact that this bone exhibits hollow spaces that are connected to the middle ear by the vestibular window.

In another known hearing aid (European Application 242 038 A2), a microphone, an amplifier, a battery, a volume control and an excitation coil, for a magnet that is fastened to one of the auditory ossicles, are placed in a housing that is to be inserted into the external auditory canal. Further, a hearing aid is known (British Patent 1 440 724) in which a microphone, an amplifier and a battery are arranged in a housing that is inserted in a plug-like manner into a base and is implanted in the temporal bone behind the external ear. The output signal of the amplifier goes to an excitation coil, implanted in the middle ear, of a magnet fastened to the stirrup bone.

Further, a hearing aid is known (U.S. Pat. No. 4,532,930) in which, by an implantable electrode arrangement, a direct electrical stimulation of the inner ear occurs with the aid of signals that are made available by a suitable signal processing electronic device. Here the signal processing electronic device is placed in a relatively large-volume housing that is carried along externally in a separate pocket. The signal processing electronic device is connected by a connecting cable to a transmitting antenna that is placed in the area of the ear in question.

In the known hearing aids, the achievable sound quality often leaves something to be desired. Adaptation problems can occur, and the stimulation by a magnet fastened to an auditory ossicle makes necessary an intervention in the chain of auditory ossicles that poses risks.

SUMMARY OF THE INVENTION

The object of this invention is to provide an implantable hearing aid to stimulate the inner ear that has a high sound quality and makes possible a relatively simple and risk-free use.

This object is achieved, according to preferred embodiments of the invention, in that the hearing aid has a hydromechanical coupling element which has an input side connected to an electromechanical converter and which transmits mechanical vibrations generated by the converter to the inner ear.

In the hearing aid according to the invention, mechanical vibrations that are generated by the electromechanical converter are transmitted by the hydromechanical coupling element, circumventing the sound transmission of the auditory ossicle in the inner ear, in the form of pressure fluctuations to the fluid-filled inner ear spaces. In this way, in a relatively simple manner, an especially effective stimulation of the inner ear with high sound quality can be achieved.

In another configuration of the invention, the hydromechanical coupling element can simply be a fluid-filled tube that is connected to the electromechanical converter. A distal end of this tube relative to the converter, in the implanted state, extends into the fluid-filled inner ear spaces.

Advantageously, the electromechanical converter is hermetically encapsulated for implantation in the tympanic cavity or mastoid. For the purpose of optimal mechanical impedance matching, the tube is, advantageously, filled with a lymph-like fluid and is closed with a thin membrane on its distal end. The tube can be permanently shaped according to the respective anatomical conditions by a slipped-on wire filament or by one or more wires embedded in the tube wall.

The electromechanical converter can be integrated within a housing of an implantable signal processing electronic device and can operate on the basis of electrodynamic, electromagnetic or, preferably, piezoelectric principles. In particular, the converter can have a piezoelectric flexural resonator sitting on a carrier membrane that is fixed in the housing receiving the converter. The flexural resonator can consist of a single-layer piezoelectric disk or can be a bimorph structure that is symmetrical to the carrier membrane, and it, advantageously, has a diameter that corresponds to at least 0.8 times and, preferably, at least 0.9 times the inner diameter of the associated housing. A large ratio of the converter disk diameter to the tube inner diameter achieves a rapid conversion which, even with small electric converter capacities, makes it possible to produce high output pressures on the distal tube end.

In another aspect of the invention, a microphone, that supplies input signals to the electromechanical converter by a signal processing electronic device, is connected to an acoustic coupling element for picking up sound from the tympanic cavity, fully exploiting the natural directional pattern of the outer ear. The acoustic coupling element can be made simply of a sound-conducting tube connected to the microphone. This tube has a distal end facing away from the microphone which, in the implanted state, projects into the tympanic cavity and, advantageously, is closed by a membrane.

Preferred embodiments of the invention are described in more detail below with reference to the drawings.

DETAILED DESCRIPTION OF THE PREFERRED EMBODIMENTS

Figure 1:
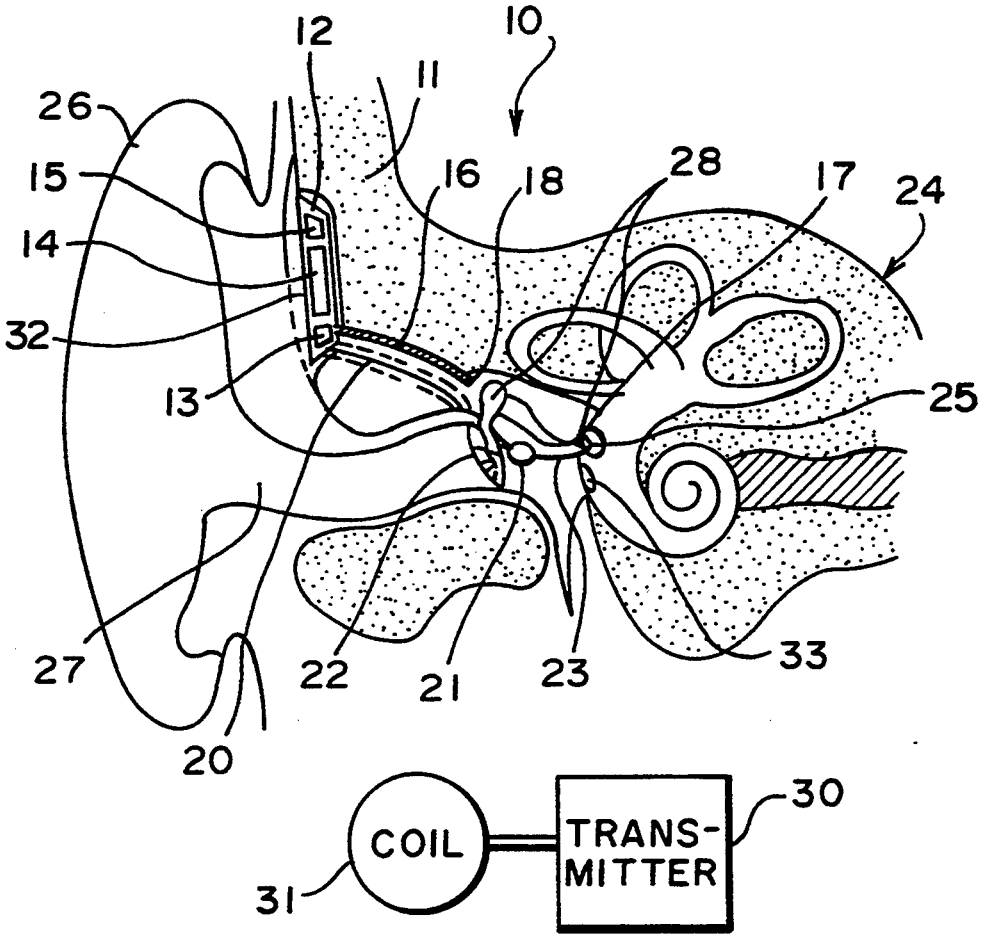
FIG. 1 is a diagrammatic section through a human ear with an implanted hearing aid, and also an external control signal transmitter.

The hearing aid represented in FIG. 1 has, in the vicinity of mastoid 11 of ear 10, an implantable, hermetically sealed housing 12 in which, as indicated diagrammatically, a microphone 13, a signal processing electronic device 14 and an energy supply, for example, a storage cell arrangement 15 (i.e., one or more rechargeable batteries) are placed. Microphone 13 is connected to tympanic cavity 17 by an acoustic coupling element in the form of a sound conducting tube 16. The distal end of sound conducting tube 16, i.e., that facing away from microphone 13, extends into the tympanic cavity 17, in the implanted state, and it is closed there by a thin membrane 18.

The output of signal processing electronic device 14 is connected, by a converter feed line 20, to an electromechanical converter 21 which is hermetically encapsulated and rigidly, mechanically fixed in the tympanic cavity behind the ear drum 22. Converter 21 is connected to a hydromechanical coupling element 23. Mechanical vibrations are transmitted from converter 21, via coupling element 23, to inner ear 24. In the embodiment illustrated in FIG. 1, for this purpose, coupling element 23 extends through a hole in the basis stapedis 25.

In the embodiment according to FIG. 1, sound signals reach the tympanic cavity 17 from outer ear 26 via the auditory canal 27 and ear drum 22. At the tympanic cavity 17, the signals are picked up by the sound conducting tube 16 behind ear drum 22, and are conveyed, further, to microphone 13 in housing 12. Microphone 13 converts the sound into electrical microphone signals, and these signals are converted into suitable output signals in signal processing electronic device 14. These output signals are conveyed by converter feed line 20 to electromechanical converter 21 in amplified form. Converter 21 converts the electrical output signals into mechanical vibrations. The mechanical vibrations are transmitted by the hydromechanical coupling element 23 to the fluid-filled inner ear spaces.

FIG. 1 makes it clear that the hearing aid is completely implanted. The wearer is not impeded by the device under normal, everyday conditions. For example, swimming is easily possible. The natural directional pattern of outer ear 26 is fully exploited and is not impaired by mechanical elements in the external auditory canal 27. After signal amplification in signal processing electronic device 14, there is no transformation of the airborne sound, making a high sound quality possible. Possible feedback problems can be relatively simply overcome. The natural transmission by the auditory ossicle chain 28 remains uninfluenced. Thus, the risk for the patient is minimized.

To selectively calibrate one or more characteristic values of signal processing electronic device 14, an external control signal transmitter 30 can be provided which has an output to which a transmitting coil 31 is connected. In such a case, a receiving coil 32 is placed in housing 12. In this way, if needed, a high-frequency, inductive data transmission can be performed by coils 31 and 32 between the external control signal transmitter 30 and the implanted signal processing electronic device 14. Advantageously, the high-frequency link provided for the inductive data transmission can also be used to transmit energy to charge implanted storage cell arrangement 15. A light-dependent infrared link can also be provided for enabling a transcutaneous data transmission between control signal transmitter 30 and signal processing electronic device 14.

Figure 2:
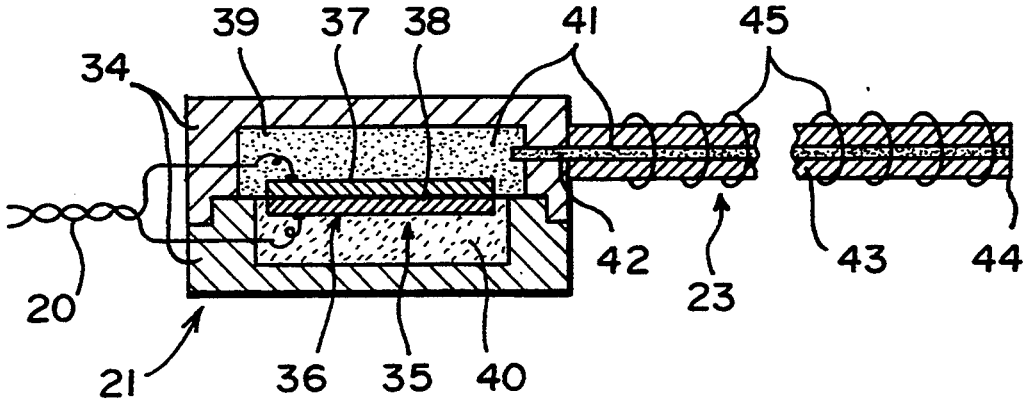
FIG. 2 is an enlarged diagrammatic section through an electromechanical converter with an associated hydromechanical coupling element for transmitting converter vibrations to the inner ear.

A preferred embodiment of an electromechanical converter 21 and of hydromechanical coupling element 23 is represented on an enlarged scale in FIG. 2. Converter 21 has a two-part, hermetically sealed housing 34. A, preferably circular, piezoelectric flexural resonator 35 that sits on a carrier membrane 36 is placed in housing 34. Carrier membrane 36, preferably consisting of brass or aluminum, is fixed at its edge approximately centrally in housing 34. Illustrated flexural resonator 35 has a bimorph structure that is symmetrical to carrier membrane 36 and whose layers are designated 37 and 38. Layers 37, 38 can be electrically parallel or connected in series. Here, the two or, with electrically parallel connection, three, electrode surfaces of layers 37, 38 are in contact and are connected by housing passages to converter feed line 20.

It is noted that, optionally, one of the two layers 37, 38 can be eliminated, so that flexural resonator 35 consists of a single-layer piezoelectric disk. Flexural resonator 35, advantageously, has a diameter that corresponds to at least 0.8 times and, preferably, at least 0.9 times the inner diameter of housing 34. Carrier membrane 36 divides the interior of housing 34 into two chambers 39 and 40. One chamber 39 is filled with a fluid 41 whose density and composition correspond, at least approximately, to perilymph (the fluid in the inner ear). A connection part 42 is guided through a wall of housing 34. This connection part 42 conveys the pressure fluctuations generated by the converter vibration to a tube 43 that forms the hydromechanical coupling element 23. Tube 43 is filled with the same fluid as chamber 39 and its distal end relative to converter 21 is closed by a thin membrane 44. Tube 43 can, suitably, consist of a biologically compatible silicone and, advantageously, it has an outer diameter of 0.3 to 1.0 mm, preferably about 0.6 mm, and a wall thickness of 0.05 to 0.3 mm, preferably about 0.1 mm.

The converter housing 34 is circular or approximately circular and, advantageously, it has a diameter of 5 to 10 mm, preferably about 8 mm. Housing 34, like housing 12, can, advantageously, be made of a biologically compatible ceramic, e.g., $Al_2O_3$, or of titanium. The second chamber 40 of housing 34 is filled with a noble gas, preferably argon. A thin wire filament 45 of biologically compatible material, preferably platinum, is coiled around tube 43. The wire filament makes it possible to achieve a stable shaping of the curvature of tube 43 to match the respective anatomical conditions. Instead of the wire filament, one or more wire filaments 45, preferably platinum wires, can be embedded in the wall of tube 43, as shown in FIG. 3.

The essential effect of the arrangement illustrated in FIG. 2 is based, on the one hand, on the principle of a pressure chamber by which it is achieved that, with a large ratio between converter disk diameter and tube inside diameter, a rapid transformation is produced which, with small electrical converter capacities, makes high output pressures at tube membrane 44 possible. On the other hand, the filling of tube 43 with a lymph-like fluid makes it possible to optimally match mechanical impedance to the inner ear. In this way, disturbing reflections (echoes) are avoided.

Figure 3:
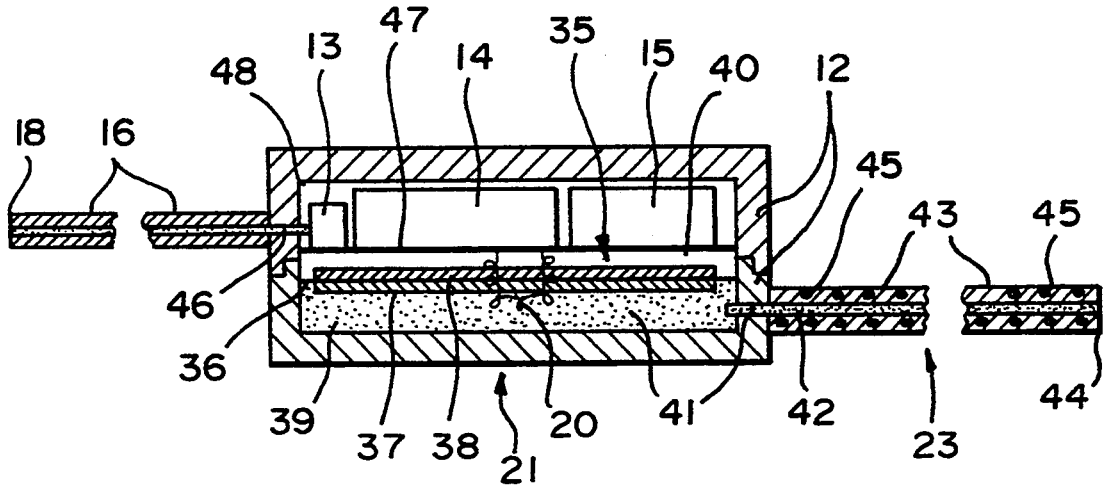
FIG. 3 is an enlarged section through the housing of a signal processing electronic device in which the electromechanical converter is also placed.

In the modified embodiment according to FIG. 3, electromechanical converter 21 is integrated within housing 12 of signal processing electronic device 14. Fluid-filled chamber 39, bounded by carrier membrane 36 of flexural resonator 35 and, in this case, also in housing 12, is connected, as in FIG. 2, to a hydromechanical coupling element 23 in the form of a fluid-filled tube 43. Further, corresponding to the embodiment of FIG. 1, a microphone 13 and the power supply, for example, a storage cell arrangement 15, are placed in housing 12.

The sound is fed to microphone 13 from tympanic cavity 17 by sound-conducting tube 16. Sound-conducting tube 16 is connected to housing 12 by a connecting part 46 and is closed on its exposed end by thin membrane 18. To avoid feedback, microphone 13 is suspended so as to be vibrationally isolated in housing 12. As indicated in FIG. 3, microphone 13, signal processing electronic device 14 and energy supply 15 are located in a third chamber 48 that is separated from gas-filled chamber 40 by a partition 47. Optionally, these subassemblies can also be placed, at least individually, in chamber 40.

For the power supply, a primary cell arrangement can also be provided that is placed in a separate housing from housing 12 of signal processing electronic device 14, and this separate housing can be connected by a detachable connection to signal processing electronic device 14. In this way, if necessary, the primary cell arrangement (one or more batteries) can be replaced without requiring a simultaneous replacement of housing 12 or access to the interior of this housing.

Further, it is possible to place the microphone 13, which picks up sound from tympanic cavity 17, in a separate housing that is fixed during implantation directly in tympanic cavity 17. Microphone 13, in this case, picks up sound from the tympanic cavity by a connecting part that is led through the housing and sealingly closed by a thin membrane.

We claim:

1. Implantable hearing aid for stimulation of the inner ear, comprising means for converting incoming sound waves into electrical signals, an electromechanical convertor for receiving said electrical signals and converting them into mechanical vibrations, and a hydromechanical coupling element which has an input side connected to the electromechanical converter and an output side which is connected to the inner ear as a means for transmitting mechanical vibrations generated by the converter directly to fluid-filled spaces of the inner ear.

2. Hearing aid according to claim 1, wherein the hydromechanical coupling element comprises a fluid-filled tube that has one end connected to the electromechanical converter and which has a distal end that extends, in the implanted state, into the fluid-filled inner ear spaces.

3. Hearing aid according to claim 1, wherein the electromechanical converter is hermetically encapsulated for implantation in the tympanic cavity or in the mastoid.

4. Hearing aid according to claim 2, wherein the distal end of the fluid-filled tube is closed.

5. Hearing aid according to claim 4, wherein the distal end is closed with a thin membrane.

6. Hearing aid according to claim 4, wherein the fluid-filled tube is filled with a fluid having the physical properties of lymph.

7. Hearing aid according to claim 2, wherein the fluid-filled tube has an outer diameter of 0.3 to 1.0 mm and a wall thickness of 0.05 to 0.3 mm.

8. Hearing aid according to claim 2, wherein a biologically compatible wire is coiled around the tube.

9. Hearing aid according to claim 2, wherein at least one wire is embedded in the wall of the tube.

10. Hearing aid according to claims 8, wherein the wire is made of platinum or a platinum alloy.

11. Hearing aid according to claim 3, wherein the electromechanical converter is placed in a converter housing that is at least approximately circular in cross section and that has a diameter of 5 to 10 mm.

12. Hearing aid according to claim 1, wherein the electromechanical converter is integrated into a housing of an implantable signal processing electronic device.

13. Hearing aid according to claim 1, wherein the electromechanical converter is selected from the group consisting of the electrodynamic, electromagnetic and piezoelectric transducers.

14. Hearing aid according to claim 1, wherein the electromechanical converter comprises a piezoelectric flexural resonator sitting on a carrier membrane, said carrier membrane being fixed in a converter housing.

15. Hearing aid according to claim 14, wherein the flexural resonator comprises a single-layer piezoelectric disk.

16. Hearing aid according to claim 14, wherein the flexural resonator has a layered bimorph structure that is symmetrical to the carrier membrane and whose layers are connected in an electrically parallel manner.

17. Hearing aid according to claim 14, wherein the flexural resonator has a layered bimorph structure that is symmetrical to the carrier membrane and whose layers are electrically connected in series.

18. Hearing aid according to claim 14, wherein the flexural resonator has a diameter that corresponds to at least 0.8 times an inner diameter of the converter housing.

19. Hearing aid according to claims 12, wherein the electromechanical converter comprises a piezoelectric flexural resonator sitting on a carrier membrane, said carrier membrane being fixed in a converter housing and dividing the interior of the converter housing into two chambers.

20. Hearing aid according to claim 19, wherein one of the two chambers is connected to the hydromechanical coupling element.

21. Hearing aid according to claim 20, wherein a first chamber of the housing is filled with a fluid whose density and composition correspond at least approximately to that of perilymph.

22. Hearing aid according to claim 20, wherein a second chamber of the housing is filled with a noble gas.

23. Hearing aid according to claim 20, wherein said means for converting sound waves comprises a chamber of the housing that is separated from the chamber connected to the hydromechanical coupling element and which receives a signal processing electronic device, a microphone and a power supply.

24. Hearing aid according to claim 1, wherein the hydromechanical coupling element is constructed for being implanted extending into the inner ear of the wearer through a hole selected from the group consisting of a hole in the base of the stapes and a hole near the round window of the ear.

25. Hearing aid according to claim 1, wherein said means for converting sound waves comprises a microphone for supplying the electromechanical converter with input signals by a signal processing electronic device which is connected to an acoustic coupling element for picking up sound from the tympanic cavity.

26. Hearing aid according to claim 25, wherein the acoustic coupling element comprises a sound-conducting tube that is connected to the microphone and whose end facing away from the microphone, in the implanted state, projects into the tympanic cavity.

27. Hearing aid according to claim 26, wherein the sound-conducting tube is closed by a membrane on a distal end facing away from the microphone.

28. A totally implantable hearing device for bypassing the ossicular chain of the human ear comprising electromechanical means for responding to sonic vibrations occurring as a result of sound waves entering the outer ear and for convening said sonic vibrations into electrical signals, signal processing and amplifying means for processing and amplifying said electrical signals, energy supply means for supplying energy to said signal processing and amplifying means, and an electromechanical convertor having an input means for receiving electrical output signals from said signal processing and amplifying means, conversion means for converting said electrical output signals into mechanical vibrations and output means for transmitting said mechanical vibrations generated by the conversion means to fluid-filled spaces of the inner ear in a manner avoiding the need to interrupt the ossicular chain.

* * * * *